US005219198A

United States Patent [19]

Davis

[11] Patent Number: 5,219,198

[45] Date of Patent: Jun. 15, 1993

[54] HANDLING DEVICE AND PROCESS FOR FASTENERS

[75] Inventor: Roger L. Davis, Hilliard, Ohio

[73] Assignee: Norfolk Southern Railway Co., Norfolk, Va.

[21] Appl. No.: 814,796

[22] Filed: Dec. 31, 1991

[51] Int. Cl.[5] ..... B25C 3/00

[52] U.S. Cl. ..... 294/19.1; 221/307; 221/280

[58] Field of Search ..... 294/19.1, 19.2; 221/199, 226, 239, 280, 307, 311; 81/13, 44; 273/32.5

[56] References Cited

U.S. PATENT DOCUMENTS

| | | | |
|---|---|---|---|
| 405,598 | 6/1889 | Raymond | 221/307 X |
| 1,576,010 | 3/1926 | Swartz | 221/311 X |
| 2,725,558 | 12/1955 | Munson | 81/44 X |
| 3,206,197 | 9/1965 | Miotke | 273/32.5 |
| 3,789,895 | 2/1974 | Levinson | 81/44 |
| 3,847,193 | 11/1974 | Brunstetter | 81/44 |
| 4,858,784 | 8/1989 | Moody | 221/307 X |
| 5,040,675 | 8/1991 | Cleveland et al. | 221/307 X |

*Primary Examiner*—Margaret A. Focarino
*Assistant Examiner*—Dean J. Kramer
*Attorney, Agent, or Firm*—Watson, Cole, Grindle & Watson

[57] ABSTRACT

A device and process for handling headed fasteners to facilitate insertion into a workpiece opening includes a hollow tube and telescoping plunger arrangement, the tube containing the fastener or fasteners which are extended one at a time through a tube slot upon movement to a collapsed position of the device. The fastener is spring gripped by its head in the process of being laterally extended through the slot, and is fully ejected from the device as the device is longitudinally moved in a rearward direction.

7 Claims, 2 Drawing Sheets

HANDLING DEVICE AND PROCESS FOR FASTENERS

BACKGROUND OF THE INVENTION

This invention relates to a device and process for handling a headed fastener to facilitate insertion into a workpiece opening, especially a workpiece opening which is not readily accessible to the operator.

This invention has particular application in the railway car art, but is of course not limited thereto. For example, when repairing the side wall structure of a railway hopper car, a crewman positioned inside the car extends what is typically referred to as a Huck Bolt through aligned openings in the structural steel elements being worked on. Another crewman on the outside of the car uses a special tool to grasp the huck bolt and apply a nut or the like to complete the fastening process. When extending the Huck Bolts through openings which are high up on the car and inaccessible by hand, the crewman within the car must elevate himself by a ladder or scaffold which as can be appreciated is not only potentially dangeous but is extremely time consuming.

The Huck Bolt is an elongated, headed and externally ridged fastener such that, when inserted through aligned openings which are inaccessible to the crewman, could easily strip the ridges rendering the outside crewman's task that much more difficult.

Long handle devices for gripping the Huck Bolt to facilitate bolt insertion in the aligned openings are unwieldy since the gripping especially of a round bolt head causes the bolt to cock during insertion or to fall away from the handler. Besides, a long handle gripper does not permit the crewman to apply sufficient force against the bolt as it is being extended through the openings because of the out-of-reach and out-of-sight location of the openings. Moreover, inserting the Huck Bolt one at a time using a long handle grip becomes extremely time consuming.

SUMMARY OF THE INVENTION

It is therefore an object of the present invention to provide a device for positively and securely handling and supporting a headed fastener, whether a Huck Bolt or other type fastener, to facilitate insertion into a workpiece opening without the many drawbacks associated with prior art devices, and in a manner which is economical and efficient yet highly effective, requires few parts and is easy to operate.

The device according to the invention includes a hollow tube containing at least one headed fastener located therein and lying in a longitudinal direction with its head facing rearwardly, the tube being open and having an open slot at its forward end. The fastener is extended through the slot upon sliding movement of a telescoping plunger within the tube in the forward direction. The open slot has an inner edge portion, and the fastener is resiliently biased against such edge portion while extending the fastener through the slot. The fastener head is resiliently gripped beneath such edge portion while causing the fastener to extend in a lateral direction through the slot.

The laterally extending fastener can be easily dispensed from the tube while applying an axial force along the fastener by longitudinally shifting the device in a rearward direction. And, a plurality of headed fasteners may be loaded in tandem within the tube in the longitudinal direction with their heads facing rearwardly, such that the fasteners can be gripped and dispensed one-at-time from the handler.

Resilient means such as a compression spring having a sloping surface confronts the inner edge portion such that during movement of the plunger toward a collapsed position the fastener slides along such sloping surface and is caused to transversly extend through the slot until the fastener head is resiliently gripped against the edge portion in readiness for insertion into the workpiece opening.

Thus, the fastener is securely held under the bias of the spring in a lateral direction relative to the elongated device, and can be extended into the workpiece opening while applying an axial force along the fastener. Thereafter, movement of the device in a rearward direction with the fastener anchored in the workpiece opening causes the fastener to be completed dispensed from the tube as assisted by the spring bias.

When the tube is loaded with a plurality of fasteners, each fastener is dispensed one-at-a-time from the tube as aforedescribed, and another fastener is extended from the tube slot by simply collapsing the plunger.

Other objects, advantages and novel features of the invention will become more apparent from the following detailed description of the invention when taken in conjunction with the accompanying drawings.

DETAILED DESCRIPTION OF THE INVENTION

Figure 1:
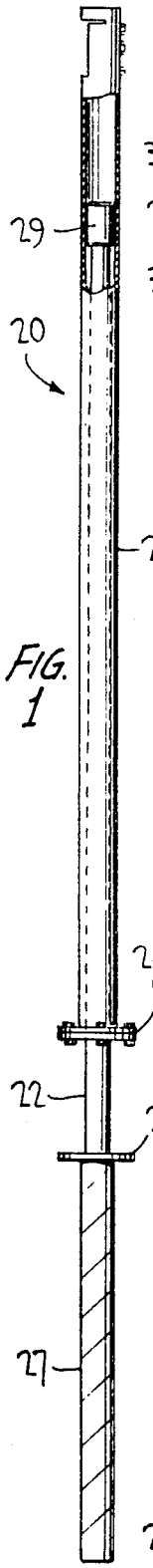
FIG. 1 is a plan view of the handling device according to the invention shown for purposes of clarity without a loaded fastener or fasteners.

Turning now to the drawings where like reference characters refer to like and the corresponding parts throughout the several views, the present handling device, generally designated 20, is shown assembled together in FIG. 1 as comprising an elongated hollow tube 21 and a hand-operated elongated plunger 22 telescoped within the tube for relative axial movement.

Figure 2:
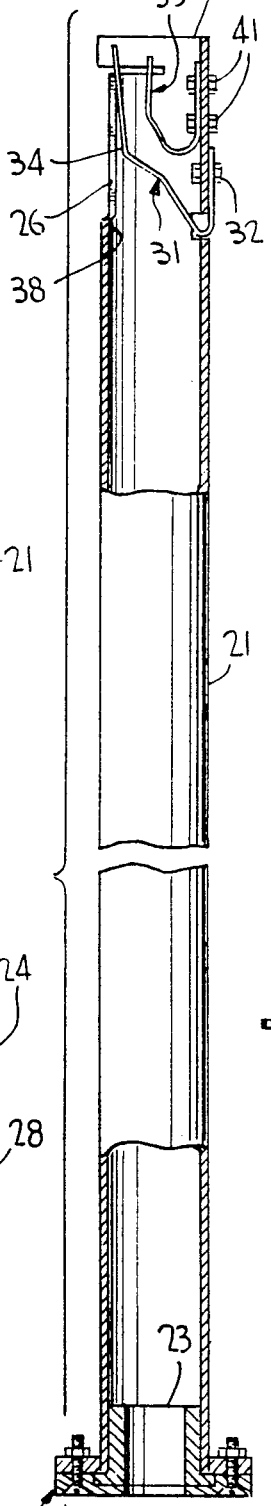
FIG. 2 is a view similar to FIG. 1 at an enlarged scale of only the elongated tube as part of the device.
Figure 3:
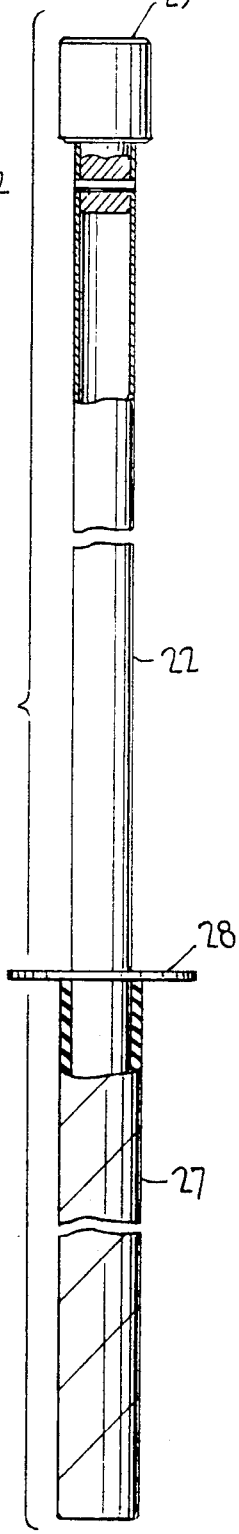
FIG. 3 is a view similar to FIG. 2 of only the plunger as another part of the device.
Figure 4:
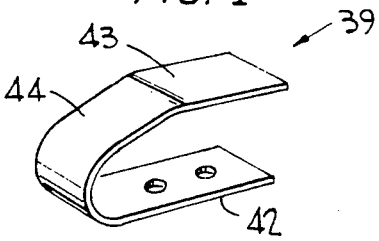
FIGS. 4 and 5 are perspective views of flat compression springs which are mounted at the slot end of the tube.

As more clearly shown in FIG. 2, the tube has a collar 23 fixedly mounted as at 24 at one end, the collar acting as a stop preventing removal of the plunger after assembly with the tube.

Opposite end 25 of the tube is open, and an open slot 26 is located adjacent end 25, the headed fasteners extending through the open slot in a manner to be described more fully hereinafter.

Plunger 22 includes a rod having a handle 27 at one end with a stop plate adjacent the handle, and a plunger head 29 is affixed to the opposite end of the plunger rod.

The tube and plunger of the device are assembled together prior to mounting collar 23 in place. Thus, the plunger head of the plunger is extended partly into the hollow tube at its one end, whereafter collar 23 is mounted in place as at 24.

Figure 5:
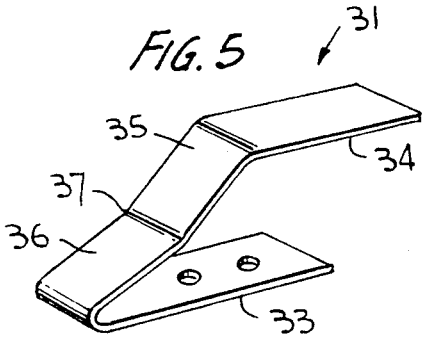
Figure 6:
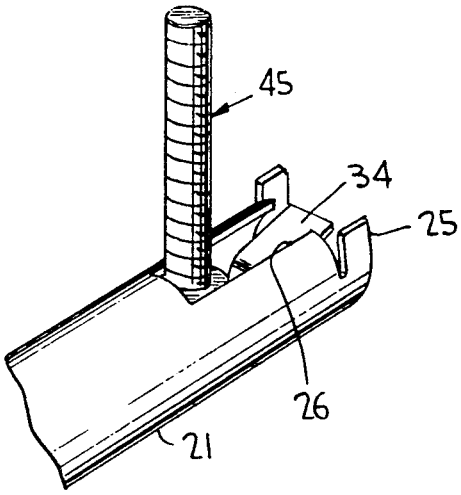
FIG. 6 is a perspective view showing a fastener laterally extending from the tube slot upon operation of the device.
Figure 7:
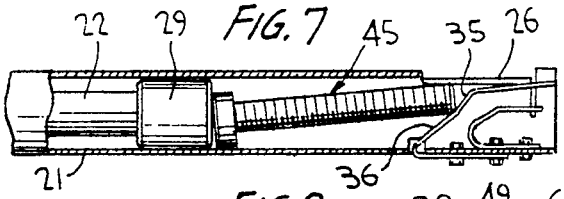
FIGS. 7 to 12 are sides views, partly in section, illustrating the operation of the device in sequential manner in which the fastener is laterally extended from the device, is inserted into a workpiece opening, and is fully dispensed from the device.

A flat plate spring 31, shown in detail in FIG. 5, is fixedly mounted at 32 adjacent end 25 of the hollow tube. The plate spring has a support leg 33 for mounting and a spaced leg 34 which may have a slight descending slope as more clearly shown in FIG. 2. And, the plate spring has sloping walls 35, 36 respectively formed integrally with legs 34 and 33, the walls being joined together and forming an internal angle at 37.

Walls 35, 36 essentially confront an inner edge portion 38 located adjacent open slot 26, as shown in FIG. 2.

Another plate spring 39 is mounted as at 41 adjacent end 25 of the hollow tube, spring 39 lying beneath plate spring 31. Spring 39 has a support leg 42 for mounting, a spaced leg 43 lying substantially parallel to leg 42, and an essentially curved spring section 44 extending between the legs.

Figure 13:
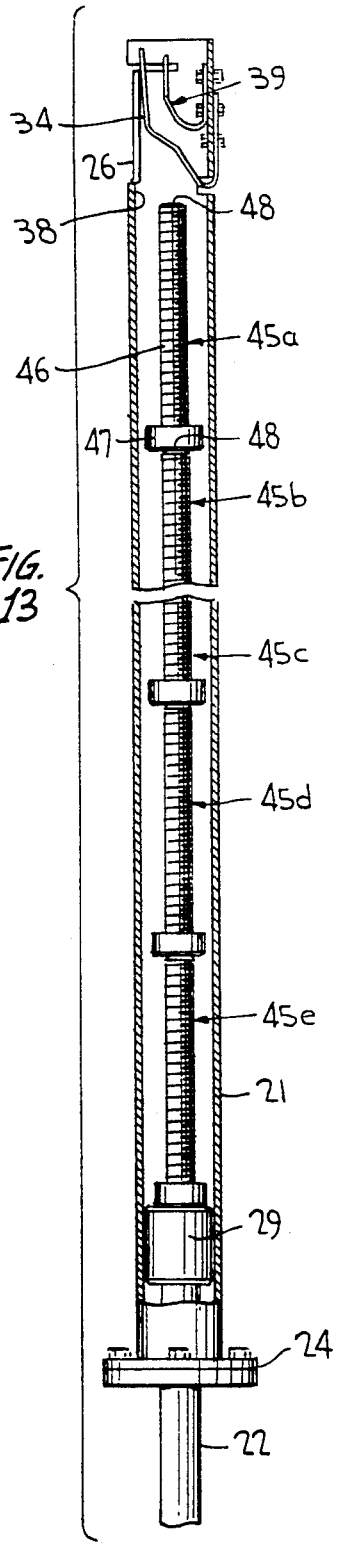
FIG. 13 is a plan view, partly in section, of the device showing the plunger fully retracted and the tube containing a plurality of fasteners loaded in tandem.

Elongated tube 21 of the present device contains at least one headed fastener 45 which is laterally positioned and ejected upon operation of the device as will be described in detail hereinafter. Preferably, a plurality of headed fasteners 45*a* to 45*e*, which may be in the form of Huck Bolts, are loaded into hollow tube 21 in tandem relationship as shown in FIG. 13. Each fastener has a threaded shank 46 and a head 47, the fasteners lying longitudinally within the tube with the tip end 48 of each fastener bearing against the flat head end of an adjacent fastener.

Plate spring 31 is positioned at slot 26 such that its spaced leg 34 may lie substantially at or within slot 26. And, sloping walls 35 and 36 of plate spring 31 are located in a position to essentially confront inner edge portion 38 of the tube in angular relationship.

Each fastener 45 is loaded one at a time into tube 21 through slot 26 with plunger 22 retracted out of the tube. Each fastener 45 is loaded head first through slot 26 against the bias of spring 31 similar to the loading of a firearm until all the fasteners, or as many as desired, are contained within the tube such that the first loaded fastener 45*e* has its head bearing against plunger head 29, shown in FIG. 13. The handling device is now ready for operation for ejecting each fastener one at a time for insertion into a workpiece opening.

Operation of the device will now be described with reference to FIGS. 7 to 12 for handling and ejecting a single fastener 45.

Figure 8:
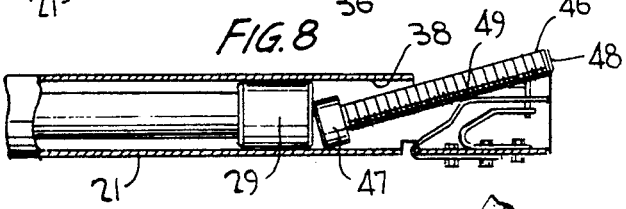

The operator simply grasps tube 21 with one hand and while holding handle 27 with the other hand relatively collapses the tube and plunger such that plunger head 29 is moved toward slot 26 to thereby push the fastener through the slot. During this process, tip end 48 of the fastener slides along sloping wall 36 until it reaches internal angle 37 of plate spring 31, shown in FIG. 7. Further movement of the plunger toward the collapsed position extends the threaded shank 46 of the fastener through slot 26 as tip end 48 slides along sloping wall 35 and slightly compresses plate spring 31 as the threaded shank bears at one side against a crown portion 49 of the spring and bears at its opposite end against inner edge portion 38, while lying at a slight angle to the longitudinal axis of the tube, as shown in FIG. 8. In this intermediate position, the bolt is spring biased against edge portion 38 and is securely held during the ejection process.

Figure 9:
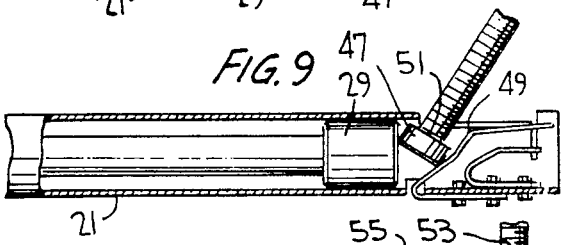

Further movement of the plunger/tube in the collapsed position of FIG. 9 eventually causes the plunger head to eject the fastener further outwardly of the slot causing its head 47 to slide along sloping wall 36 of spring 31 and causing the fastener shank to extend at a steeper angle through the slot, until shoulder 51 formed between head 47 and shank 46 engages inner edge portion 38.

Figure 10:
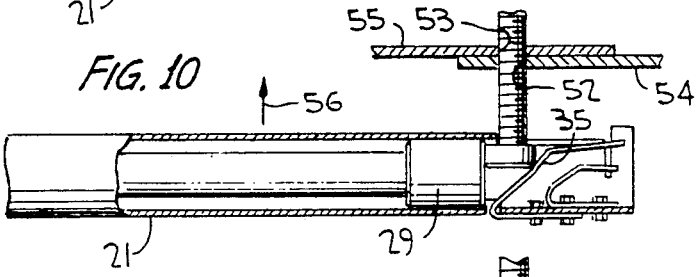

Further collapsing movement of the device causes the fastener to pivot from its FIG. 9 to its FIG. 10 position as the head slides along sloping wall 35 of spring 31 so as to extend the fastener laterally through slot 26. In the FIG. 10 position, the fastener is securely held by its head 47 in readiness for insertion into the desired workpiece opening.

In the FIG. 10 position, the fastener is aligned with openings such as 52 and 53 of workpieces 54 and 55 to be fastened together. Upon movement of the device in the direction of arrow 56, the threaded fastener is inserted partially through aligned openings 52 and 53 without cocking or dislodgement from the device.

Figure 11:
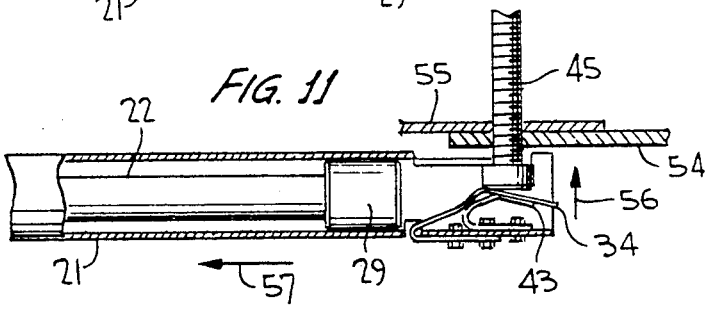
Figure 12:
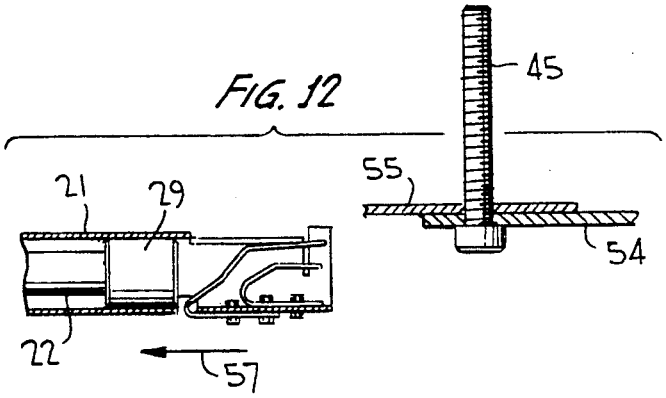

From the FIG. 10 position, the tube and plunger of the device are rearwardly moved together in the direction of arrow 57 of FIG. 11 while maintaining a pressing force by the operator in the direction of arrow 56. During such rearward movement, while the fastener is anchored in aligned openings 52 and 53, the fastener is resiliently pushed further into the openings of the workpieces as its head 47 is caused to slide over crown portion 49 and into engagement with leg 34 of plate spring 31 to thereby compress both plate spring 31 and plate spring 39 lying therebeneath, as shown in FIG. 11. The spring bias of both plate springs therefore assist in further extending the fastener in a lateral direction through the aligned openings of the workpieces. Further movement of the device in the direction of arrow 57 completely releases the fastener from the device without interference from open end 25 of the device, as shown in FIG. 12.

Operation of the device for positioning and ejecting a plurality of fasteners one at a time, as when loaded in FIG. 13, is the same as described with reference to FIG. 7 to 12.

From the foregoing, it can be seen that a simple and efficient yet highly effective bolt handler has been devised for ejecting headed fasteners one-at-a-time as each fastener is extended from an ejection slot of the device in a lateral position while being positively gripped in readiness for insertion into a workpiece opening without likelihood of cocking or falling away from the device before insertion. Plate spring 31 facilitates both spring loading and spring orientation of the fastener, and this spring together with an underlying plate spring facilitates further insertion of each fastener into the workpiece opening as the device is simply moved away from the inserted fastener.

The bolt handler of the invention is especially advantageous for fastener insertion through otherwise inaccessible workpiece openings beyond the reach of the operator.

Obviously, many modifications and variations of the present invention are made possible in light of the above teachings. For example, underlying plate spring 39 could be eliminated without departing from the invention, and spring means other than a plate spring or springs could be effectively utilized within the spirit of the invention.

It is therefore to be understood that within the scope of the appended claims the invention may be practiced otherwise than as specifically described.

What is claimed is:

1. A device for handling a headed fastener to facilitate insertion into a workpiece opening, comprising, a hollow tube for the reception of at least one headed fastener lying in a longitudinal direction along the said tube, a plunger telescoped within said tube for relative axial movement from a telescopically extended to a telescopically collapsed position for pushing the fastener through an open slot provided at an end of said tube, said open slot being located in a side wall of said tube adjacent a terminal end of said tube, said open slot having an inner edge portion, resilient means fixed within said tube opposite said slot, said means having a wall sloping in a direction toward said slot and toward said terminal end, said wall confronting said inner edge portion such that during the relative axial movement toward said collapsed position the fastener is caused to slide along said sloping wall and is caused to laterally extend through said slot until the fastener head is resiliently held against said edge portion in readiness for insertion into the workpiece opening.

2. The device according to claim 1, wherein said resilient means comprises at least one compression spring having an outer wall adjoining said sloping wall, the held fastener releasing from said edge portion and bearing against said outer wall to compress said spring upon release of the fastener from the said tube.

3. The device according to claim 2, wherein said resilient means comprise a pair of spaced plate springs located one beneath the other.

4. The device according to claim 1, wherein said tube has a predetermined length for containing a plurality of headed fasteners in tandem.

5. A process for handling a headed fastener to facilitate insertion into a workpiece opening comprising the steps of: providing a hollow tube having at least one headed fastener located therein and lying in a longitudinal direction with the head thereof facing rearwardly, the tube having an open slot at a forward end thereof and a plunger telescoped within the tube; extending the fastener through the slot upon relative sliding movement of the plunger and the tube toward a collapsed condition, the open slot having an inner edge portion; resiliently biasing the fastener against said inner edge portion while extending the fastener through the slot; resiliently gripping the head of the fastener beneath said edge portion while causing the fastener to extend in a lateral direction through the slot, and dispensing the laterally extending fastener from the tube by longitudinally shifting the tube in a rearward direction.

6. The process according to claim 5, further comprising resiliently urging the laterally extending fastener into the workpiece opening while shifting the tube in said rearward direction.

7. The process according to claim 5, further comprising loading a plurality of headed fasteners in tandem within the tube in said longitudinal direction with the heads thereof facing rearwardly, the extending, resiliently biasing and resiliently gripping steps being carried out one-at-a-time for each of the fasteners.

* * * * *